US006179650B1

(12) United States Patent
Chih-Kai

(10) Patent No.: US 6,179,650 B1
(45) Date of Patent: Jan. 30, 2001

(54) MODULARIZED ELECTRIC CONNECTOR

(75) Inventor: Chang Chih-Kai, Sanchung (TW)

(73) Assignee: Tekcon Electronics Corp., Taipei Hsien (TW)

( * ) Notice: Under 35 U.S.C. 154(b), the term of this patent shall be extended for 0 days.

(21) Appl. No.: 09/481,520

(22) Filed: Jan. 12, 2000

(51) Int. Cl.[7] ..... H01R 13/66; H01R 9/22
(52) U.S. Cl. ..... 439/540.1; 439/717
(58) Field of Search ..... 439/540.1, 527, 439/717

(56) References Cited

U.S. PATENT DOCUMENTS

| | | | | |
|---|---|---|---|---|
| 4,469,393 | * | 9/1984 | Chewning, Jr. et al. | 439/717 |
| 4,797,123 | * | 1/1989 | Weber | 439/717 |
| 5,125,854 | * | 6/1992 | Bassler et al. | 439/607 |
| 5,797,767 | * | 8/1998 | Schell | 439/490 |

* cited by examiner

*Primary Examiner*—Brian Sircus
*Assistant Examiner*—Chandrika Prasad

(74) *Attorney, Agent, or Firm*—Robert E. Bushnell, Esq.

(57) ABSTRACT

A modularized electric connector, which includes a housing, the housing having a longitudinal coupling tongue and a longitudinal coupling groove respectively provided at two opposite sides and two locating flanges respectively provided at two opposite lateral sides at different elevations near the bottom, a terminal holder fastened to the housing to hold a plurality of terminals, the terminal holder having two vertical coupling flanges reversely arranged at two opposite sides, wherein the longitudinal coupling tongue, longitudinal coupling groove and locating flanges of the housing and the vertical coupling flanges of the terminal holder are so arranged that when two modularized electric connectors are arranged together, the longitudinal coupling tongue at the housing of a first modularized electric connector can be coupled to the longitudinal coupling groove at the housing of a second modularized electric connector, enabling the locating flange at one side of the housing of the first modularized electric connector to be pressed against the locating flange at one side of the housing of the second modularized electric, and the coupling flange at one side of the vertical block of the terminal holder of the first modularized electric connector can be coupled to the coupling flange at one side of the vertical block of the terminal holder of the second modularized electric connector.

5 Claims, 5 Drawing Sheets

MODULARIZED ELECTRIC CONNECTOR

BACKGROUND OF THE INVENTION

The present invention relates to a modularized electric connector, and more particularly to such a modularized electric connector that enables the user to connect a plurality of modularized electric connectors positively in a row without the use of a tool or any fastening elements.

FIGS. 5 and 6 show an electric connector for use in a printed circuit board to receive an electric plug for electric signal transmission. This structure of electric connector must be individually installed. When multiple electric connectors are used and arranged together, fastening means must be used to secure the electric connectors in position. In making an electric connector device having multiple connector units, the manufacturing procedure is complicated, and the manufacturing cost is high.

SUMMARY OF THE INVENTION

It is the main object of the present invention to provide a modularized electric connector, which allows the user to connect a plurality of modularized electric connectors positively in a row without the use of a tool or any fastening elements. According to the present invention, the modularized electric connector comprises a housing, a terminal holder having a flat horizontal base fastened to the housing and a vertical block disposed outside the housing, and a plurality of terminals installed in the terminal holder. The housing comprises a longitudinal coupling tongue and a longitudinal coupling groove respectively provided at two opposite sides near the top, and two locating flanges respectively provided at two opposite lateral sides at different elevations near the bottom. The terminal holder comprises two vertical coupling flanges reversely arranged at two opposite sides. The longitudinal coupling tongue, longitudinal coupling groove and locating flanges of the housing and the vertical coupling flanges of the terminal holder are so arranged that when two modularized electric connectors are arranged together, the longitudinal coupling tongue at the housing of a first modularized electric connector can be coupled to the longitudinal coupling groove at the housing of a second modularized electric connector, enabling the locating flange at one side of the housing of the first modularized electric connector to be pressed against the locating flange at one side of the housing of the second modularized electric, and the coupling flange at one side of the vertical block of the terminal holder of the first modularized electric connector can be coupled to the coupling flange at one side of the vertical block of the terminal holder of the second modularized electric connector.

DETAILED DESCRIPTION OF THE PREFERRED EMBODIMENT

Figure 1:
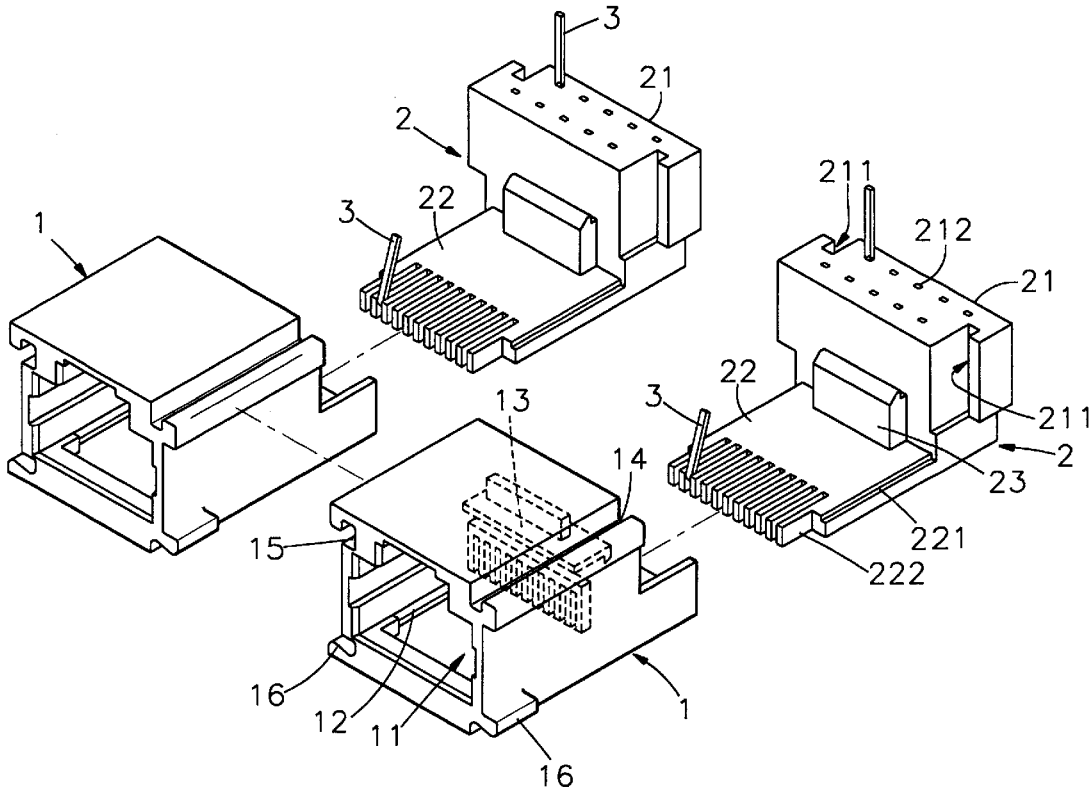
FIG. 1 is an exploded view of two modularized electric connectors according to the present invention.

Referring to FIG. 1, a modularized electric connector in accordance with the present invention is comprised of a housing 1, a terminal holder 2, and a set of terminals 3.

The housing 1 comprises a receiving chamber 11 for receiving a module plug, two sliding grooves 12 bilaterally longitudinally provided inside the receiving chamber 11 at the bottom side. a hooked flange 13 transversely provided inside the receiving chamber 11 at the top side, a longitudinal coupling tongue 14 and a longitudinal coupling groove 15 respectively provided at two opposite lateral side walls thereof on the outside near the top, and two locating flanges 16 respectively provided at the two opposite lateral side walls on the outside at different elevations near the bottom. The locating flanges 16 each have a top surface smoothly curved upwardly outwards. The longitudinal coupling tongue 14 and the longitudinal coupling groove 15 are so arranged that the housings 1 of two modularized electric connectors can be fastened to each other side by side by coupling the longitudinal coupling flange 14 of one housing 1 to the longitudinal coupling groove 15 of the other.

The terminal holder 2 comprises a flat horizontal base 22, a vertical block 21 perpendicularly raised from one end, namely, the rear end of the flat horizontal base 22, a hooked flange 23 raised from the flat horizontal base 22 and formed integral with the front side wall of the vertical block 21, two vertically extended coupling flanges 211 respectively provided at two opposite vertical lateral side walls of the vertical block 21 and arranged in reversed directions, a plurality of terminal slots 212 respectively extended through the vertical block 21 and the flat horizontal base 22 for the installation of the terminals 3, two sliding rails 221 provided at two opposite lateral sides of the flat horizontal base 22 corresponding to the sliding grooves 12 in the receiving chamber 11 inside the housing 1, and a row of partition strips 222 forwardly extended from the front side of the flat horizontal base 22 for separating the terminals 3 from one another. The terminals 3 each have a front end extended out of the flat horizontal base 22 of the terminal holder 2 and turned upwardly obliquely backwards, and a rear end extended out of the top side of the vertical block 21 of the terminal holder 2.

Figure 2:
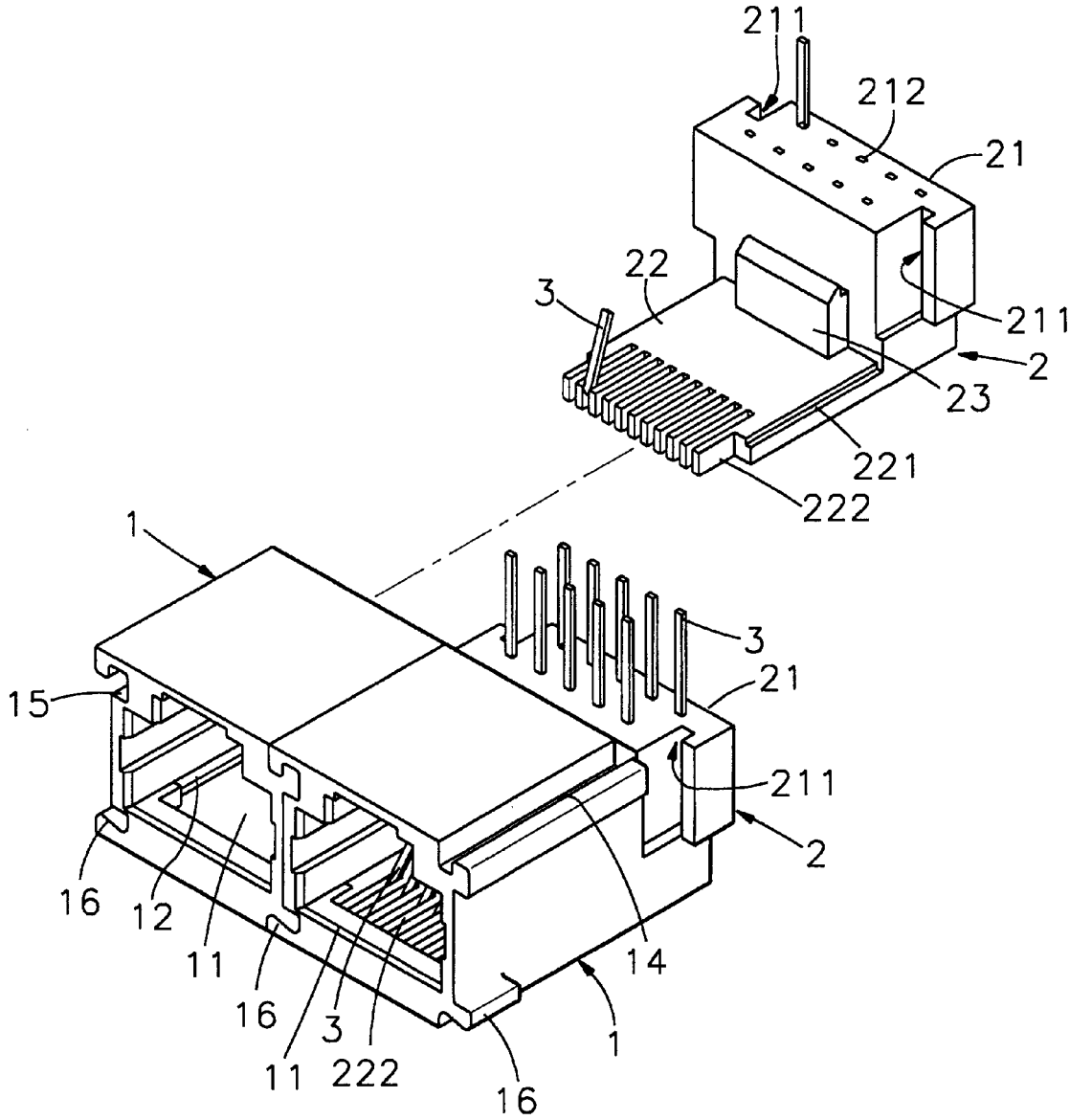
FIG. 2 is an assembly view of FIG. 1 before the installation of the terminal holder of the second modularized electric connector.
Figure 3:
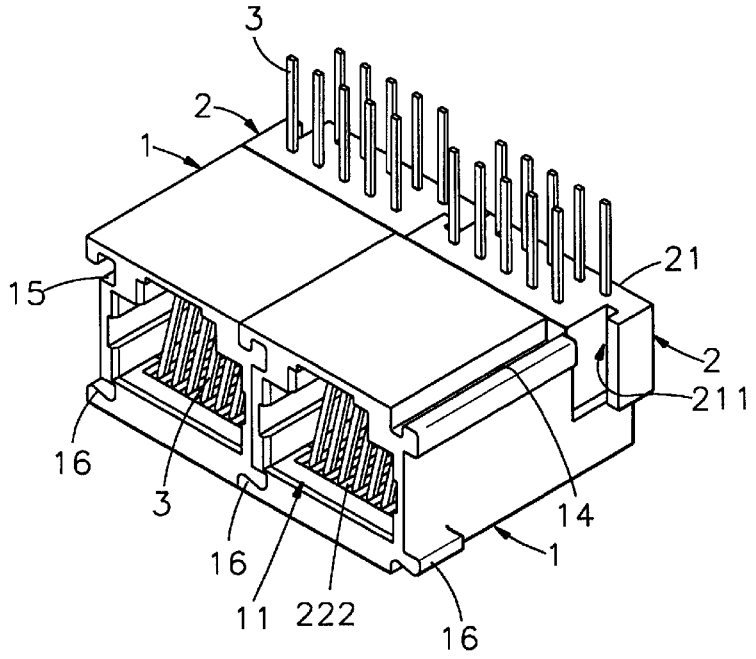
FIG. 3 shows the two modularized electric connectors of FIG. 1 assembled and coupled together.
Figure 4:
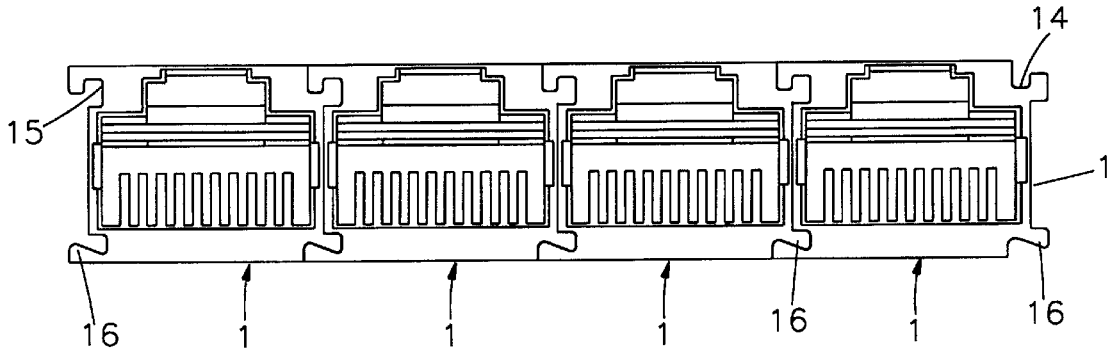
FIG. 4 is a front view showing multiple modularized electric connectors connected in a row.
Figure 5:
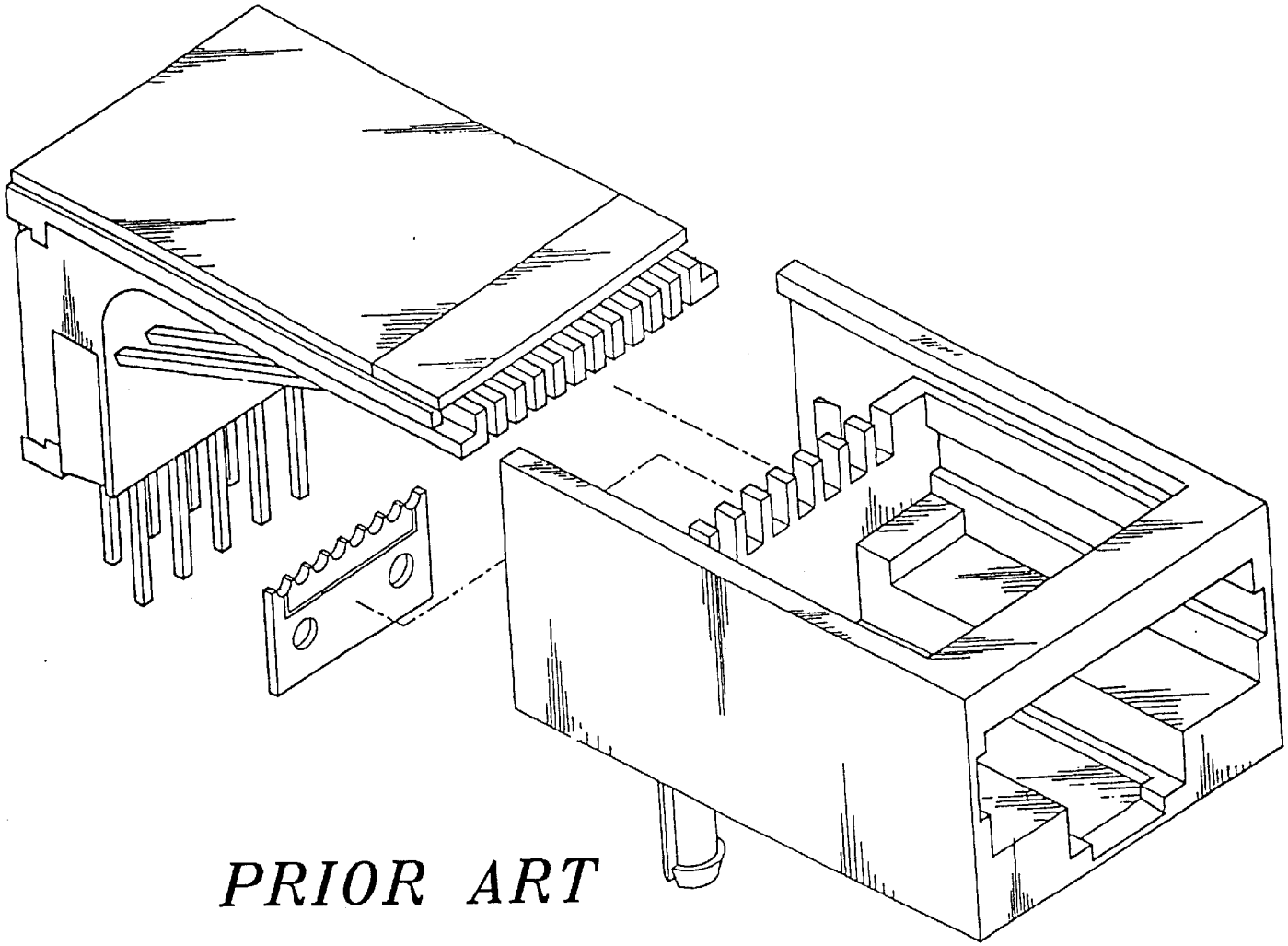
PRIOR ART FIG. 5
FIG. 5 is an exploded view of an electric connector according to the prior art.
Figure 6:
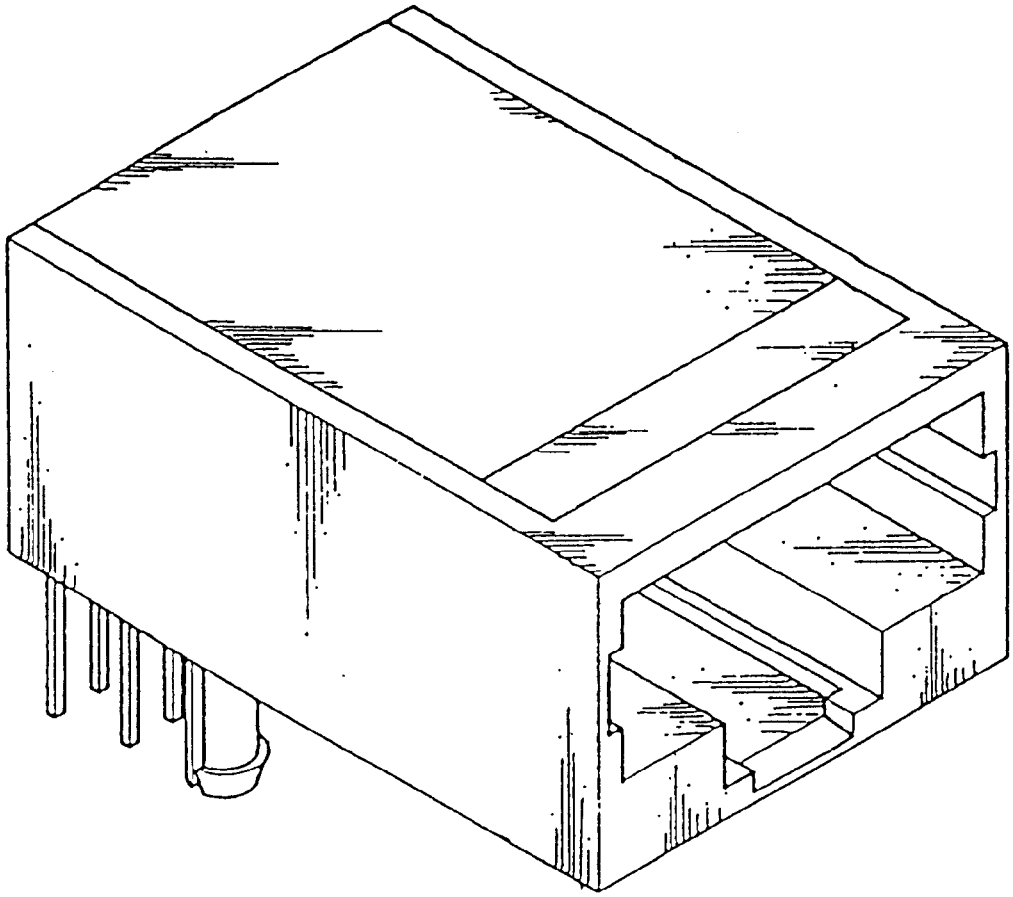
PRIOR ART FIG. 6
FIG. 6 is an assembly of the electric connector shown in FIG. 5.

Referring to FIGS. from 2 through 4 and FIG. 1 again, after installation of the terminals 3 in the terminal slots 212, the sliding rails 211 of the terminal holder 2 are respectively aimed at the sliding grooves 12 in the housing 1, then the flat horizontal base 22 of the terminal holder 2 is inserted into the receiving chamber 11 in the housing 1 from the back side of the housing 1. When inserted, the hooked flange 23 at the terminal holder 2 is forced into engagement with the hooked flange 13 in the housing 1, and therefore the terminal holder 2 and the housing 1 are firmly secured together (see FIG. 2). After assembly of a modularized electric connector, the housing 1 of a second modularized electric connector is fastened to the housing 1 of the first modularized electric connector. When the longitudinal coupling flange 14 of the housing 1 of the first modularized electric connector and the longitudinal coupling groove 15 of the second modularized electric connector are coupled together, the locating flange 16 at one side of the housing 1 of the second modularized electric connector is pressed on the locating flange 16 at one side of the housing 1 of the first modularized electric connector. (see FIG. 2). After the housing 1 of the second modularized electric connector has been fastened to the housing 1 of the first modularized electric connector, the terminal holder 2 of the second modularized electric connector is installed in the housing 1 of the second modularized electric connector. When installed, the coupling flange 211 at one side of the vertical block 21 of the terminal holder 2 of the second modularized electric connector is forced into engagement with the coupling flange 211 at one side of the vertical block 21 of the terminal holder 2 of the first modularized electric connector, and therefore the two modularized electric connectors are firmly secured together (see FIG. 3). By means of the aforesaid mounting procedure, multiple modularized electric connectors can be connected in a row as shown in FIG. 4.

Because the housing 1 and the terminal holder 2 are respectively modularized, the fabrication of the modularized electric connector is simple and inexpensive.

While only one embodiment of the present invention has been shown and described, it will be understood that various modifications and changes could be made thereunto without departing from the spirit and scope of the invention disclosed.

What the invention claimed is:

1. A modularized electric connector comprising:

a housing, said housing comprising a receiving chamber for receiving a module plug, a longitudinal coupling tongue and a longitudinal coupling groove respectively provided at two opposite lateral side walls thereof on the outside near a top side thereof, and two locating flanges respectively provided at the two opposite lateral side walls on the outside at different elevations near a bottom side thereof;

a terminal holder, said terminal holder comprising a flat horizontal base fastened to the receiving chamber in said housing, a vertical block perpendicularly raised from a rear end of said flat horizontal base and disposed outside said housing, two vertically extended coupling flanges respectively provided at two opposite vertical lateral side walls of said vertical block and arranged in reversed directions, a plurality of terminal slots respectively extended through said vertical block and said flat horizontal base;

a plurality of terminals respectively mounted in said terminal slots in said terminal holder;

wherein said longitudinal coupling tongue, said longitudinal coupling groove and said locating flanges of said housing are so arranged that when two modularized electric connectors are arranged together, the longitudinal coupling tongue at the housing of a first modularized electric connector can be coupled to the longitudinal coupling groove at the housing of a second modularized electric connector, enabling the locating flange at one side of the housing of the first modularized electric connector to be pressed against the locating flange at one side of the housing of the second modularized electric connector; and the coupling flange at one side of the vertical block of the terminal holder of the first modularized electric connector can be coupled to the coupling flange at the other side of the vertical block of the terminal holder of the second modularized electric connector.

2. The modularized electric connector of claim 1 wherein said housing comprises two longitudinal sliding grooves bilaterally disposed inside said receiving chamber, and a hooked flange transversely provided inside said receiving chamber at a top side; said terminal holder comprises two sliding rails provided at two opposite lateral sides of said flat horizontal base and respectively inserted into the sliding grooves in said housing, and a hooked flange raised from said flat horizontal base and formed integral with a front side wall of said vertical block and forced into engagement with the hooked flange in said housing.

3. The modularized electric connector of claim 1 wherein said locating flanges of said housing each have a top surface smoothly curved upwardly outwards.

4. The modularized electric connector of claim 1 wherein said terminal holder comprises a plurality of partition strips forwardly extended from a front side of said flat horizontal base to separate said terminals from one another.

5. The modularized electric connector of claim 1 wherein said terminals each having a front end extended out of the flat horizontal base of said terminal holder and turned upwardly obliquely backwards.

* * * * *